US007540565B2

(12) United States Patent
Lipford

(10) Patent No.: US 7,540,565 B2
(45) Date of Patent: Jun. 2, 2009

(54) LIFT CHAIR

(76) Inventor: William D. Lipford, 15040 Kay Circle Dr., Monroe, MI (US) 48161

( * ) Notice: Subject to any disclaimer, the term of this patent is extended or adjusted under 35 U.S.C. 154(b) by 116 days.

(21) Appl. No.: 11/517,708

(22) Filed: Sep. 8, 2006

(65) Prior Publication Data

US 2007/0057554 A1 Mar. 15, 2007

Related U.S. Application Data

(60) Provisional application No. 60/715,203, filed on Sep. 9, 2005.

(51) Int. Cl.
*A47C 1/00* (2006.01)

(52) U.S. Cl. ..... 297/325; 297/68; 297/71; 297/344.12; 297/344.18; 297/284.3; 297/344.15

(58) Field of Classification Search ..... 297/68, 297/71, 344.12, 344.18, 284.3
See application file for complete search history.

(56) References Cited

U.S. PATENT DOCUMENTS 3,138,402 A * 6/1964 Heyl, Jr. et al. ..... 297/69
3,640,566 A * 2/1972 Hodge ..... 297/68
4,007,960 A * 2/1977 Gaffney ..... 297/71
4,249,774 A * 2/1981 Andreasson ..... 297/311
5,061,010 A * 10/1991 LaPointe ..... 297/325
5,069,504 A * 12/1991 Felling ..... 297/184.15
5,127,705 A * 7/1992 Antoine et al. ..... 297/68
5,219,204 A * 6/1993 Bathrick et al. ..... 297/321
5,466,046 A * 11/1995 Komorowski et al. ..... 297/325
5,482,350 A * 1/1996 Komorowski et al. ..... 297/85
5,556,121 A * 9/1996 Pillot ..... 280/304.1
5,931,532 A * 8/1999 Kemmerer et al. ..... 297/330
5,984,411 A * 11/1999 Galumbeck ..... 297/344.15
6,056,362 A * 5/2000 de la Haye ..... 297/314
6,161,229 A * 12/2000 Ryan et al. ..... 4/667
6,217,114 B1 * 4/2001 Degonda ..... 297/325
6,244,662 B1 * 6/2001 Porcheron ..... 297/383
6,431,109 B1 * 8/2002 Martin ..... 114/363
6,557,934 B2 * 5/2003 Wiecek ..... 297/84
6,604,791 B1 * 8/2003 Chen ..... 297/330
6,752,459 B2 * 6/2004 Deisig ..... 297/316
6,871,910 B2 * 3/2005 Hale ..... 297/330
6,912,746 B2 * 7/2005 Grove ..... 5/618
6,974,186 B1 * 12/2005 Chang ..... 297/68
7,000,988 B2 * 2/2006 Bressler et al. ..... 297/325
7,011,362 B1 * 3/2006 Huang ..... 297/89
7,025,415 B1 * 4/2006 Wu ..... 297/119
7,029,070 B2 * 4/2006 Hale ..... 297/330

* cited by examiner

*Primary Examiner*—Katherine W Mitchell
*Assistant Examiner*—Jeff Tang
(74) *Attorney, Agent, or Firm*—Warn Partners, P.C.

(57) ABSTRACT

The present invention is a chair having a first seat portion operably associated with a second seat portion, with the first seat portion disposed in the same plane as the second seat portion, and an actuator for moving the first seat portion relative to the second seat portion. When the actuator is actuated, the first seat portion will pivot relative to the second seat portion such that the first seat portion is located in a different plane compared to the second seat portion.

19 Claims, 7 Drawing Sheets

LIFT CHAIR

FIELD OF THE INVENTION

The present invention relates to lift chairs which are used to aid in going from a seated position to a standing position.

BACKGROUND OF THE INVENTION

There are several lift chair products that are currently in use in the marketplace. Typically, these lift chairs have a single flat seated which is lifted and rotated to allow the user to exit the chair with minimal effort. Additionally, the seat angle will allow the occupant's back to be tilted forward, but the hips and knees remain significantly behind the lower leg which can limit the person's ability to safely exit from the chair. This can present an even greater problem particularly with the elderly whose muscles and coordination have diminished with age.

Accordingly there exists a need for an improved lift chair which allows the user to safely enter and exit the chair, and go from a seated position to a standing position, or vice versa.

SUMMARY OF THE INVENTION

The present invention is a lift chair which allows the seated occupant to have a significantly more accommodating angle which going to a standing position to reduce the possibility of accidentally falling forward or ineffectively managing the weight transfer to a metal walker. Among other needs, the present invention specifically addresses the areas of hip or knee related mobility problems, especially among the elderly, who may be living alone or want a degree of independence that does not require assistance from other individuals. Additionally, the present invention can allow for an optional leg rest design to be incorporated within the chair which can be lever managed, if leg rest capability or leg or foot circulatory relief is also desired.

The present invention is a chair having a first seat portion operably associated with a second seat portion, with the first seat portion disposed in the same plane as the second seat portion, and an actuator for moving the first seat portion relative to the second seat portion. When the actuator is actuated, the first seat portion will pivot relative to the second seat portion such that the first seat portion is located in a different plane compared to the second seat portion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
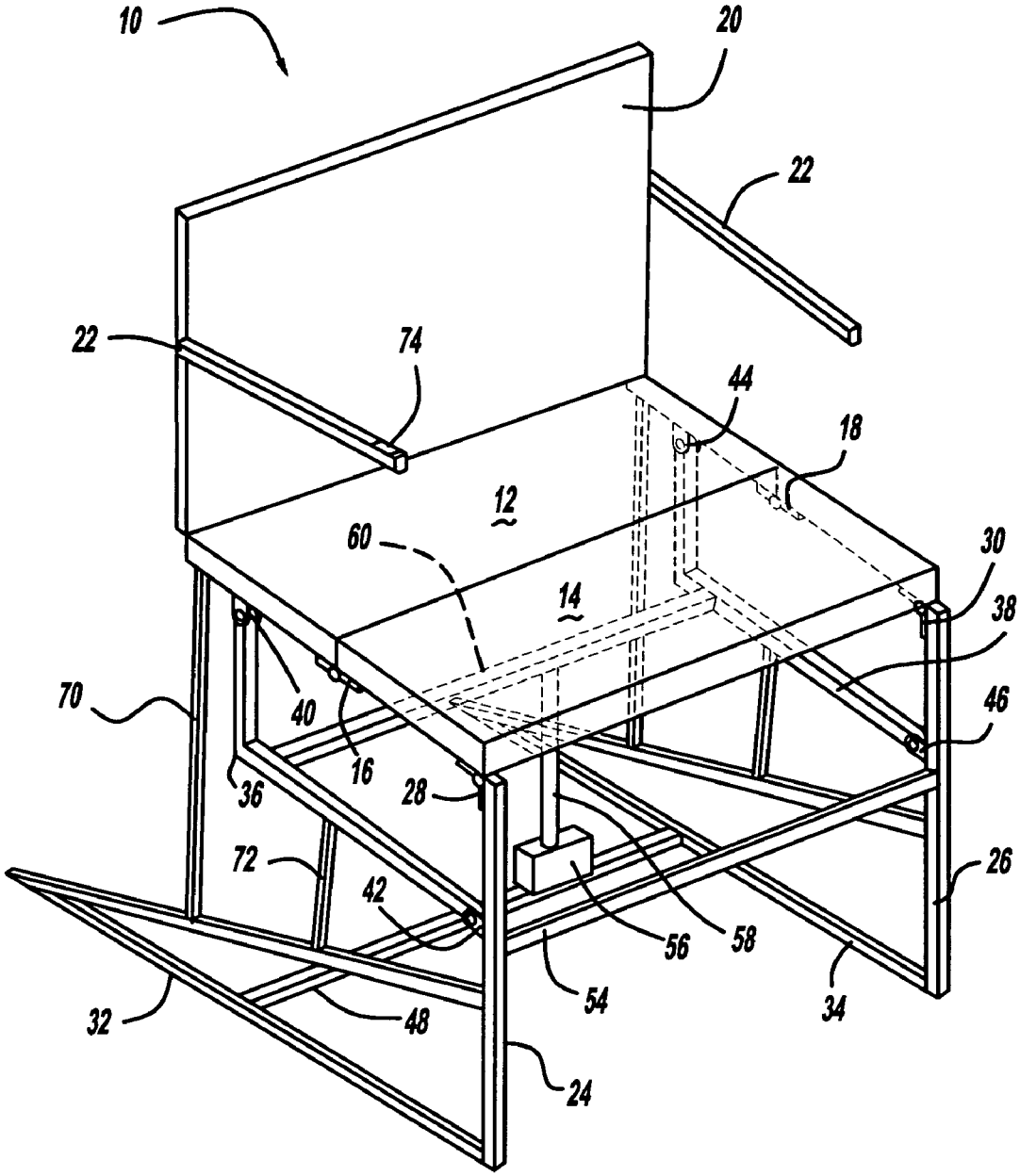
FIG. 1 is a perspective view of a lift chair, according to the present invention.
Figure 2:
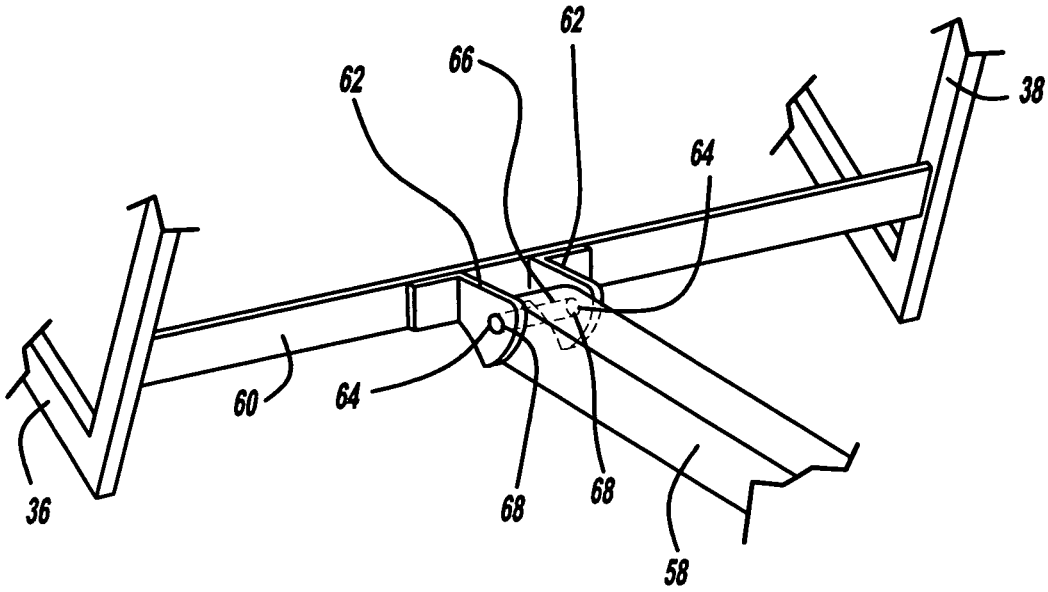
FIG. 2 is a bottom perspective view of a first seat portion used in a lift chair, according to the present invention.
Figure 3:
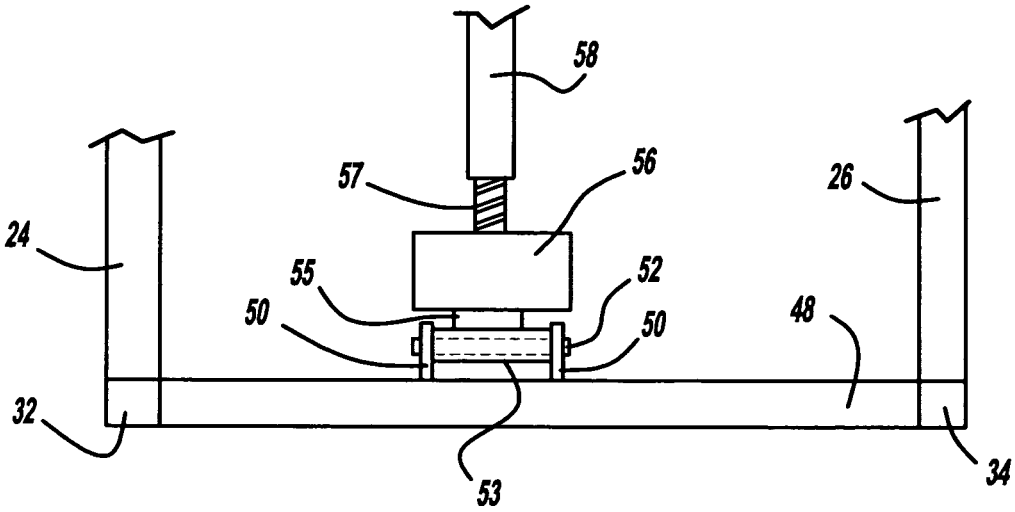
FIG. 3 is a rear view of a lift motor screw mechanism used in a lift chair, according to the present invention.

A stand-up chair according to the present invention is shown in FIG. 1 at 10. The chair 10 includes a first seat portion 12 and a second seat portion 14. The first seat portion 12 is connected to the second seat portion 14 with a first hinge 16 and a second hinge 18. Also connected to the first seat portion 12 is a backrest 20; the backrest 20 is fixedly connected to the first seat portion 12, and does not move relative to the first seat portion 12.

The backrest 20 includes at least one armrest 22 for supporting the arm of a user when sitting in the chair 10. The armrest 22 is also used for support when getting out of the chair 10 to stand up.

Connected to the second seat portion 14 is a first front support member 24 and a second front support member 26. The first front support member 24 is connected to the second seat portion 14 with a third hinge 28, and the second front support member 26 is connected to the second seat portion 14 with a fourth hinge 30. Connected to the first front support member 24 is a first V-bracket 32, and connected to the second front support member 26 is a second V-bracket 34. The brackets 32,24 are used for supporting the first and second front support members 24,26.

Located underneath the first seat portion 12 and the second seat portion 14 in a first L-bracket 36, and a second L-bracket 38. The first L-bracket 36 is connected to the first seat portion 12 with a fifth hinge 40, and to the first front support member 24 through a sixth hinge 42. The second L-shaped bracket 38 is also connected to the first seat portion 12 with a seventh hinge 44, and to the second front support member 26 by an eighth hinge 46.

Providing additional structural support for the chair 10 is a lower frame member 48 connected to the first and second V-brackets 32,34. The lower frame member 48 is also used to support an actuator for changing the positions of the first seat portion 12 and the second seat portion 14. The lower frame member 48 has a pair of flanges 50 which receive a pin 52. The pin 52 is also inserted through a bushing 53 which supports the actuator. In this embodiment, the actuator is a motor mount 55 and a lift motor screw mechanism having an electric motor 56, a screw member 57, and a threaded sleeve 58. Also providing additional support is a front frame member 54, which is connected to the first front support member 24 and the second front support member 26.

The threaded sleeve 58 has a threaded surface (not shown) on the inside of the sleeve 58 which surrounds the screw member 57 of the electric motor 56. The threaded sleeve 58 is connected to an upper frame member 60, which is connected to the first and second L-brackets 36, 38. The upper frame member 60 also includes a pair of flanges 62 which have holes 64 for receiving a pin 66. The pin 66 is also inserted into a set of holes 68 in the threaded sleeve 58 in a manner allowing the sleeve 58 to pivot about the pin 66.

Also providing support are a pair of elongated support members 70, which are connected to the first and second V-brackets 32,34, and support the first seat portion 12. There is also a pair of shortened support members 72 which are also connected to the first and second V-brackets 32,34 and support the first L-bracket 36 and the second L-bracket 38. The support provided by the elongated support members 70 and the shortened support members 72 reduces the amount of stress placed on the threaded sleeve 58, screw member 57, and motor 56 when the chair 10 is in the position shown in FIG. 4. Also, the elongated support members 70 and the shortened support members 72 can be used for attaching upholstery or any other type of fabric or fiberboard materials for giving the chair 10 a more finished look. Adding fabric to the outside of the chair 10 will also at least partially hide the motor 56, screw member 57, and threaded sleeve 58, creating a more pleasing appearance.

Located on one of the armrests 22 is a switch 74, the switch 74 is used for operating the electric motor 56. In operation, when the user of the chair 10 is sitting in the chair 10, and would like to stand up, the switch 74 can be used to activate the motor 56. The motor 56 will rotate the screw member 57, which will then cause the threaded sleeve 58 to apply force to the flanges 62 by way of the pin 66. Applying force to the flanges 62 will also apply force to the upper frame member 60, and therefore the first and second L-brackets 36,38. As this occurs, the first seat portion 12 will lift off of the elongated support members 70, and the first and second L-brackets 36,38 will lift off of the shortened support members 72. At this time, the first seat portion 12 will rotate about the first and second hinges 16,18 relative to the second seat portion 14, the second seat portion 14 will rotate relative to the front support members 24,26 by way of the hinges 28,30, the first L-bracket 36 will rotate relative to the first seat portion by way of the fifth hinge 40, and will also rotate relative to the first front support member 24 by way of the sixth hinge 42, and the second L-bracket 38 will rotate relative to the first seat portion 12 by way of the seventh hinge 44, and will rotate relative to the second front support member 26 by way of the eighth hinge 28.

Figure 4:
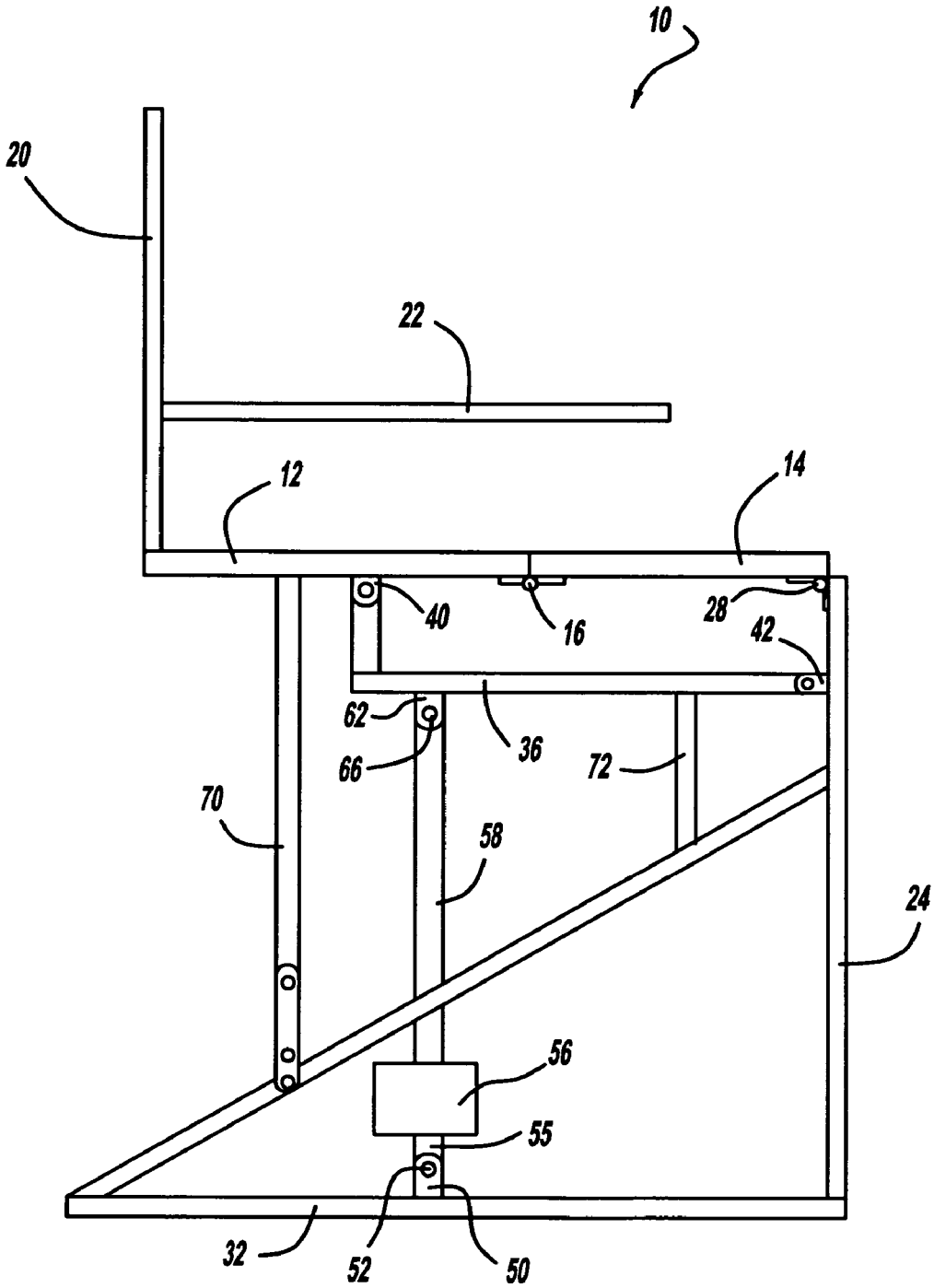
FIG. 4 is a side view of a frame used in a lift chair in a first position, according to the present invention.
Figure 5:
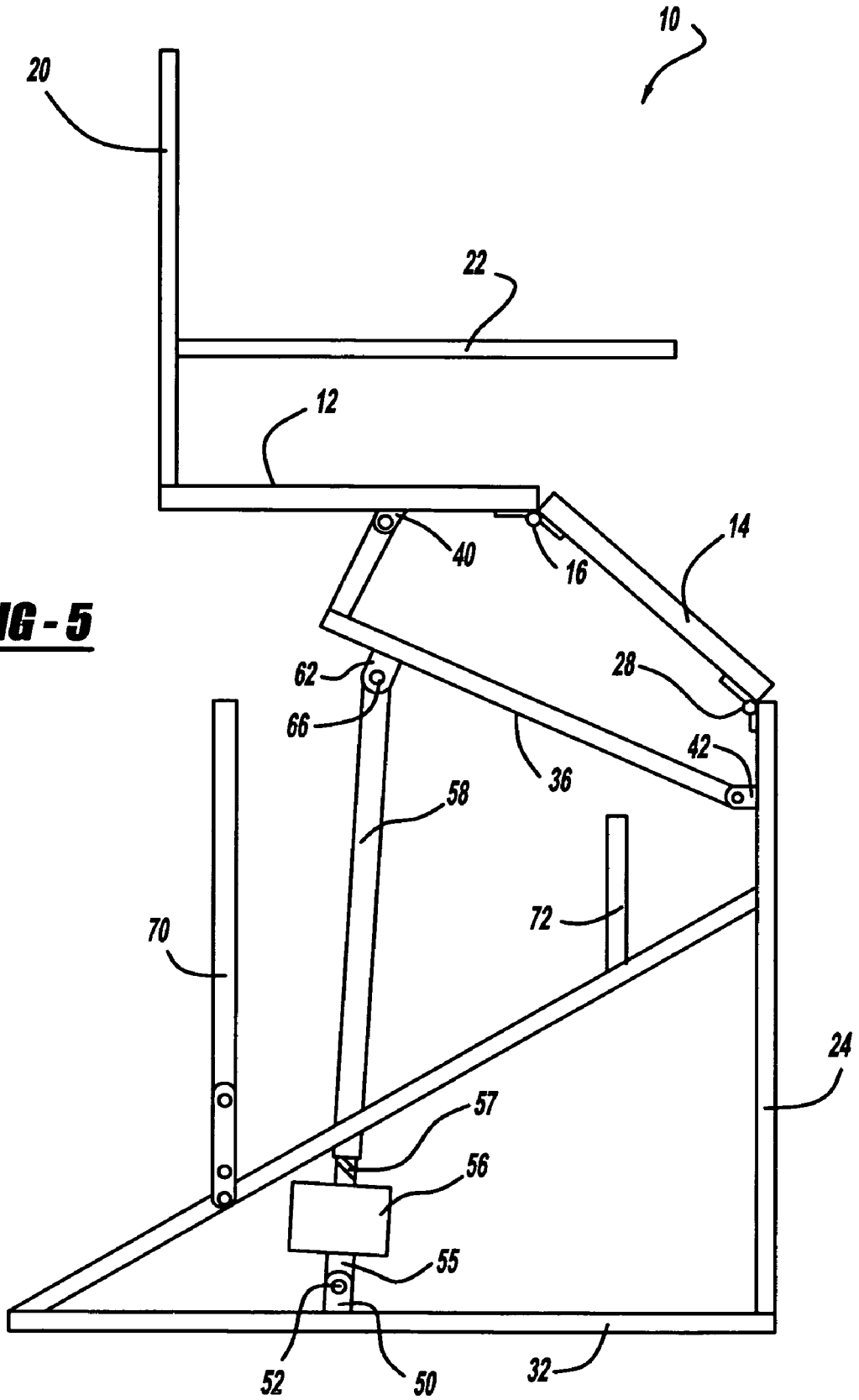
FIG. 5 is a second side view of a frame used in a lift chair as the lift chair is moving from a first position to a second position, according to the present invention.
Figure 6:
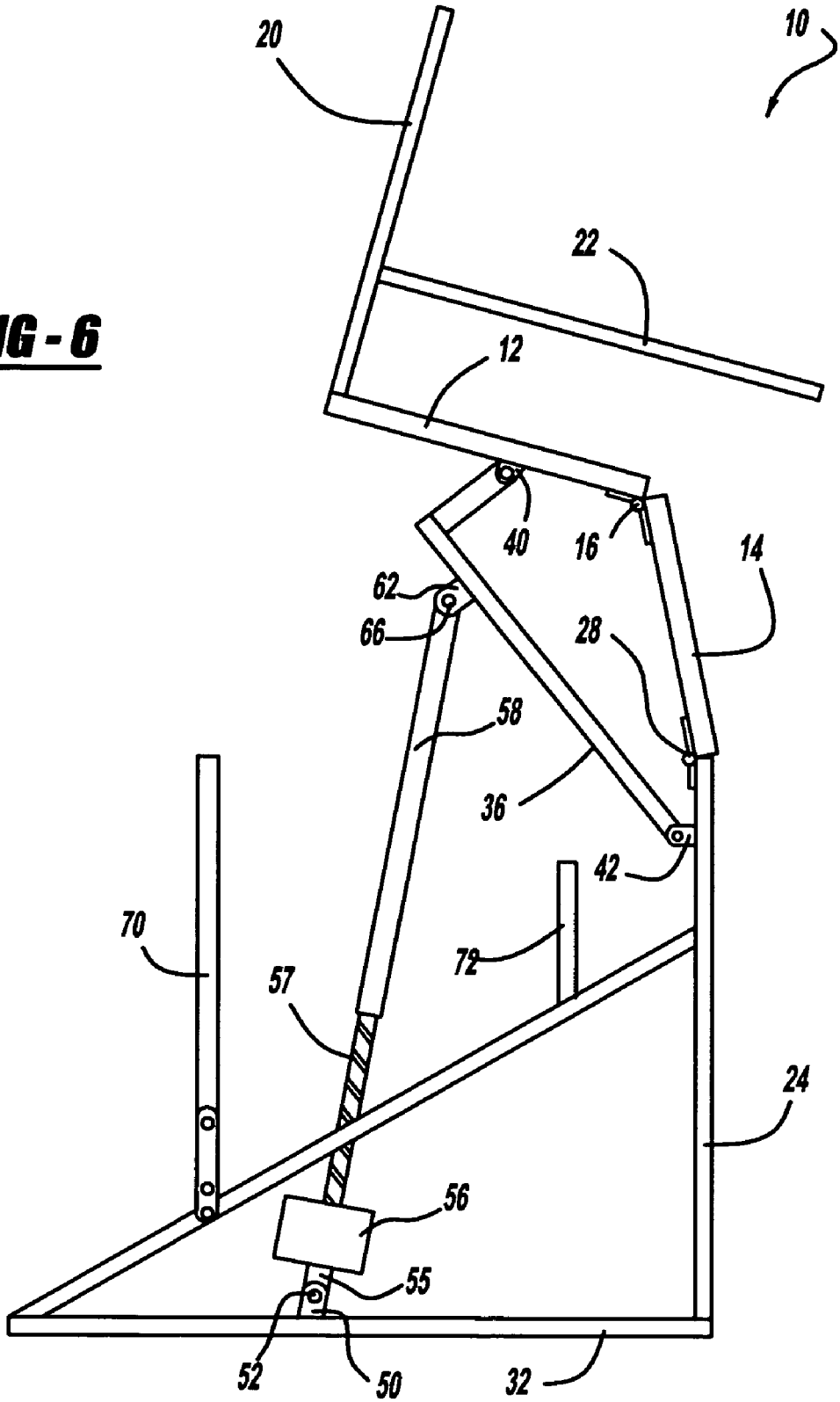
FIG. 6 is a third side view of a frame used in a lift chair in a second position, according to the present invention.

FIGS. 4, 5, and 6 show one side of the chair 10 to demonstrate the movements of the various components of the chair 10. The chair 10 is in a first position, or seated position shown in FIG. 4. When the first seat portion 12 and the second seat portion 14 are in the first position, the first seat portion 12 and the second seat portion 14 will be in the same plane. As the various parts of the chair 10 move relative to one another, the chair 10 will be in a position similar to FIG. 5. Once the first seat portion 12 moves relative to the second seat portion 14, the first seat portion 12 will be in a different plane from the second seat portion 14. As the motor 56 continues to rotate the screw member 57, the threaded sleeve 58 will continue to apply force to upper frame member 60, and the chair 10 will be in a second position or standing position shown in FIG. 6. In this second position, the first seat portion 12 will be substantially perpendicular to the second seat portion 14.

As the motor 56 drives the sleeve 58 to change the position of the chair 10 to the position shown in FIG. 6, the motor 56 will pivot about the pin 52 because of the bushing 53 and the motor mount 55, and the threaded sleeve 58 will pivot about the pin 66 in the holes 64 of the flanges 62. The motor 56 along with the threaded sleeve 58 allows the chair 10 to go from the position shown in FIGS. 1 and 4, to the position shown in FIG. 6. Once the chair 10 is in the position shown in FIG. 6, the user will easily be able to change from a sitting position to a standing position using the armrests 22, and because the user's center of gravity will be underneath their body.

Note that the user will sit on the first seat portion 12 and the second seat portion 14 when sitting in the chair 10. Having this "split-seat" has several advantages. In FIG. 6, when the chair 10 is configured to aid a person in standing up, the second seat portion 14 is aligned with front support members 24,26; this alignment provides a stop position where the motor 56 will cease to extending the threaded sleeve 58 any further. Having the second seat portion 14 aligned with the front support members 24,26 allows the user to position their legs underneath their body to provide a more postural position when exiting the chair 10, more easily facilitating exiting the chair 10. Additionally, the chair 10 is also safer because there is no exposed floor access when the motor 56 is actuated for the occupant is going to stand up. The motor 56, screw member 57, and threaded sleeve 58 are all surrounded by the first and second V-brackets 32,34, the elongated support members 70, and the shortened support members 72. This prevents exposure the floor area underneath the chair 10, and will therefore prevent a child from accessing the area underneath the chair 10 surrounding the motor 56.

The chair 10 can be left in the position shown in FIG. 6 until the user desires to sit back down in the chair 10. Once the user desires to sit back down, the user can simply rest against the first seat portion 12, and the armrests 22. At this point the user's center of gravity will be underneath their body, and the switch 74 can be used to activate the motor 56 to lower the chair 10 back to the position shown in FIGS. 1 and 4.

Figure 7:
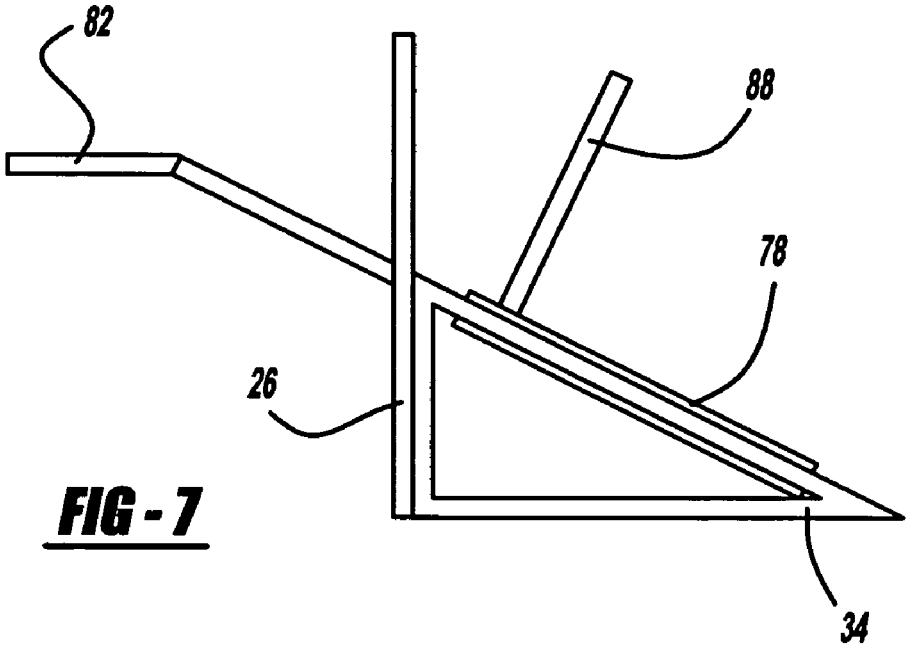
FIG. 7 is a side view of a V-bracket and a second front support member incorporating a leg rest in an extended position, according to the present invention.
Figure 8:
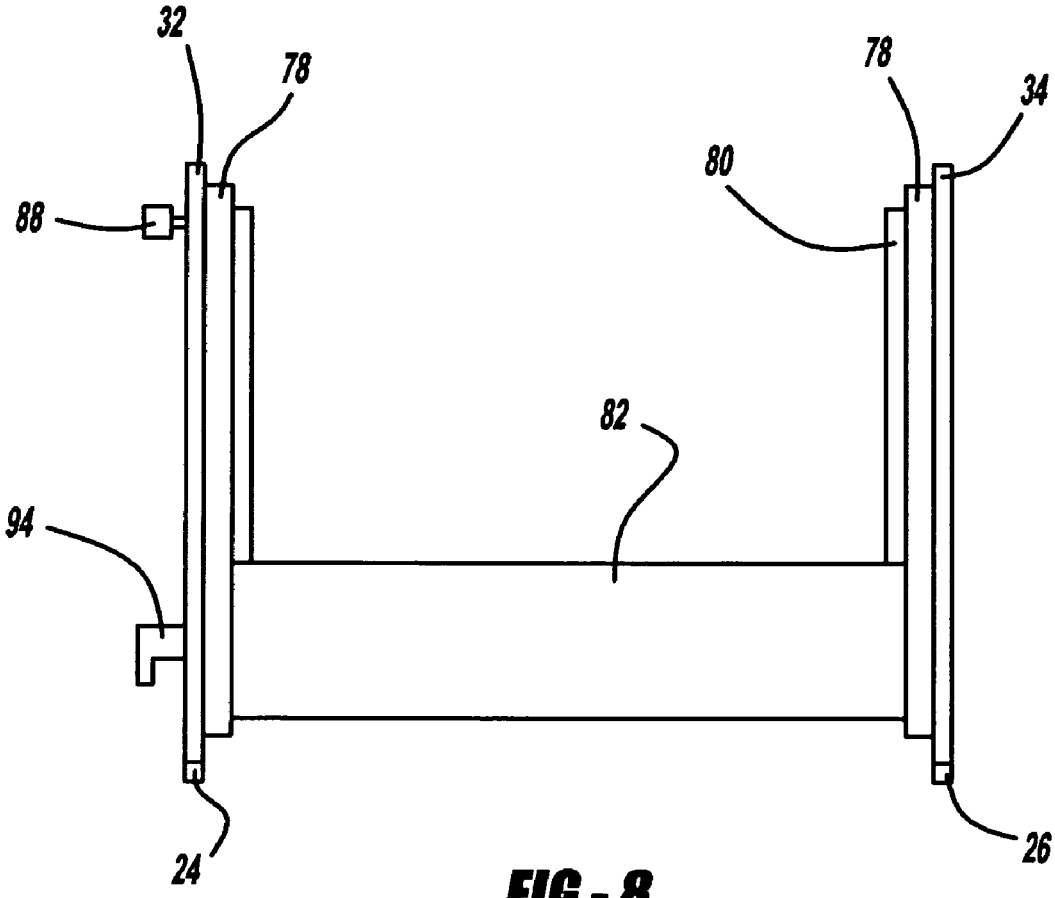
FIG. 8 is a sectional top view of a lift chair mechanism incorporating a leg rest in a retracted position, according to the present invention.
Figure 9:
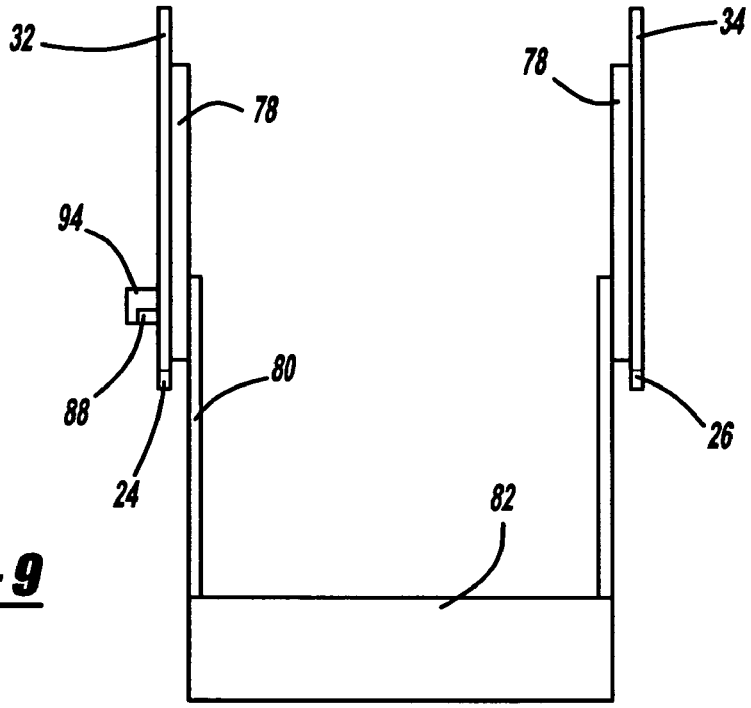
FIG. 9 is a sectional top view of a lift chair incorporating a leg rest in an extended position, according to the present invention.
Figure 10:
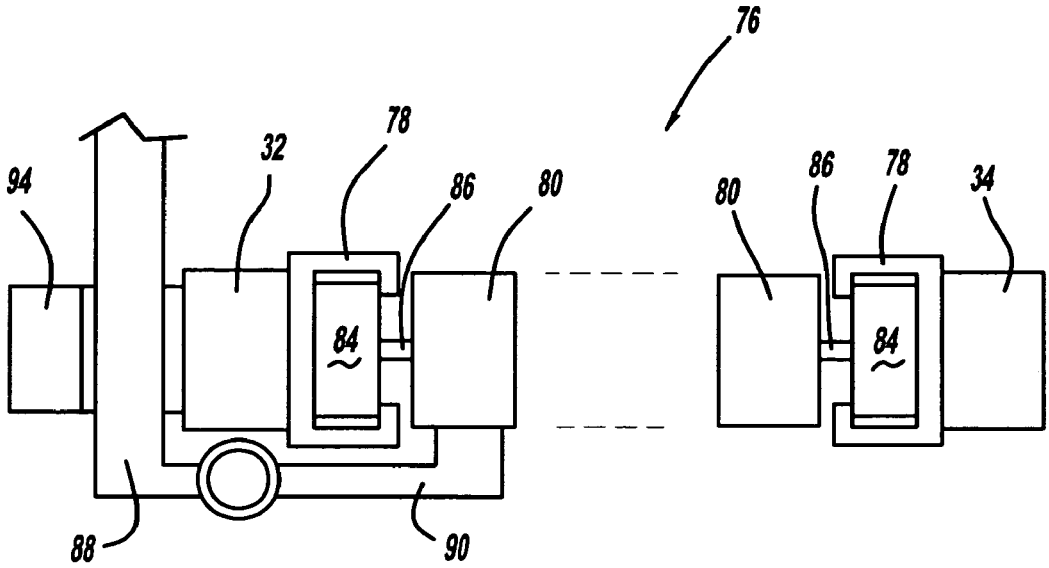
FIG. 10 is a sectional front view of a first V-bracket and a second V-bracket having a leg rest in an extended position, according to the present invention.

FIGS. 7-9 show an optional leg rest feature which can be incorporated into the present invention. The leg rest 76 includes a pair of C-shaped track members 78 which are mounted to the first V-bracket 32 and the second V-bracket 34. Also included is a leg rest frame 80 which supports a footrest 82. The frame 80 is also connected to a set of rollers 84, each of which is mounted on and free to rotate about a shaft 86. Each shaft 86 is connected to the leg rest frame 80. Also included in the leg rest 76 is a handle 88 which is connected to the frame 80 by way of a hinge 90. Connected to the hinge 90 is a spring (not shown) to bias the handle 88 to be in the position shown in FIGS. 7 and 10, and connected to the first V-bracket 32 is a receiving bracket 94, both the function of which will be described later.

To use the leg rest 76, the handle 88 is used to move the entire leg rest 76 from a retracted position shown in FIG. 8, to an extended position shown in FIG. 9. Referring to FIG. 8, the handle is simply pushed toward the first and second front support members 24,26. As this occurs, the frame 80 will be pushed in the same direction, and will be allowed to do so by the rollers 84 rotating in the track members 78. Moving the frame 80 will also move the footrest 82 away from the first and second front support members 24,26, allowing the user to rest their feet on the footrest 82. As the footrest 82 is being moved to the extended position, the handle 88 is pivoted about the hinge 90 to allow the handle 88 to go around the receiving bracket 94. Once the handle 88 has moved past the receiving bracket 94, the handle 88 can be moved to a vertical position relative to the track members 78 shown in FIGS. 8 and 10 such that the handle 88 can be inserted into the receiving bracket 94 to maintain the leg rest 76 in the extended position shown in FIG. 9.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A chair comprising:

a first seat portion operably associated with a second seat portion, said first seat portion disposed in the same plane as said second seat portion;

an actuator for moving said first seat portion relative to said second seat portion;

at least one front support member pivotally connected to said second seat portion;

at least one substantially shaped L-bracket pivotally connected to said at least one front support member and pivotally connected to said first seat portion, said actuator being operatively connected to said at least one substantially shaped L-bracket;

at least two substantially vertical support members, one of said at least two substantially vertical support members operable for supporting one of said first seat portion or said second seat portion when said first seat portion is disposed in the same plane as said second seat portion, and another of said at least two substantially vertical support members being operable for supporting said at least one substantially shaped L-bracket when said first seat portion is disposed in the same plane as said second seat portion; and wherein when said actuator is actuated, said actuator moves said substantially shaped L-bracket, which in turn moves said second seat portion, causing said first seat portion to pivot relative to said second seat portion such that said first seat portion is located in a different plane compared to said second seat portion, and one of said first seat portion or said second seat portion will lift off one of said at least two substantially vertical support members, and said at least one substantially shared L-bracket will lift off of another of said at least two substantially vertical support members, and said second seat portion is positioned for removing direct support of a user's legs from said second seat portion, and said first seat portion is positioned at an angle and moves forward, thereby allowing the user to position their legs underneath their body.

2. The chair of claim 1, wherein said actuator moves said first seat portion to a position where said first seat portion is substantially perpendicular to said second seat portion.

3. The chair of claim 1, further comprising:

a first hinge and a second hinge for connecting said first seat portion to said second seat portion;

a backrest connected to said first seat portion, at the opposite end of said first seat portion as said first hinge and said second hinge, at least one armrest connected to said backrest; and wherein when said first seat portion is moved by said actuator, said first seat portion will rotate relative to said second seat portion about said first hinge and said second hinge, and said backrest will move with said first seat portion.

4. The chair of claim 3, further comprising:

said at least one front support member including a first front support member connected to said second seat portion with a third hinge, and a second front support member connected to said second seat portion with a fourth hinge;

a front frame member connected to said first front support member and said second front support member;

a first V-bracket connected to said first front support member, and a second V-bracket connected to said second front support member; and wherein when said actuator is actuated, said second seat portion will rotate relative to said first front support member about said third hinge and said second front support member about said fourth hinge.

5. The chair of claim 4, further comprising:

said at least one substantially shaped L-bracket including a first substantially shaped L-bracket and a second substantially shaped L-bracket operably associated with said first seat portion;

said at least one substantially vertical support member including at least one substantially vertical elongated support member connected to said V-bracket for supporting said first seat portion when said first seat portion and said second seat portion are in a first position; and wherein when said first seat portion is moved relative to said second seat portion, said first substantially shaped L-bracket and said second substantially shaped L-bracket will rotate relative to said first seat portion, allowing said second seat portion to become positioned in a different plane from said first seat portion.

6. The chair of claim 1, further comprising a leg rest comprising:

at least one track member;

a leg rest frame having at least one roller disposed within said track member;

a footrest connected to said frame;

a handle connected to said frame with a hinge;

a receiving bracket operably associated with said handle; and wherein when force is applied to said handle, said at least one roller will roll in said track member, allowing said leg rest frame and said footrest to move from a retracted position to an extended position, and when said leg rest frame and said footrest are in said extended position, said handle is inserted into said receiving bracket to maintain said leg rest frame and said footrest in said extended position.

7. The stand up chair of claim 1, wherein said actuator is a lift motor screw mechanism comprising:

an electric motor having a screw member;

a threaded sleeve operably associated with said screw member, said threaded sleeve operable to be pivoted in relation to said first seat portion; and wherein when said electric motor is actuated, said screw member will rotate causing said threaded sleeve to translate along said screw member, applying force to said first seat portion.

8. The standup chair of claim 1, further comprising a switch for activating said actuator.

9. A stand up chair, comprising:

a first seat portion;

a second seat portion disposed in the same plane as said first seat portion when said first seat portion and said second seat portion are in a first position;

a first hinge and a second hinge for connecting said first seat portion and said second seat portion;

an actuator operably associated with said first seat portion;

at least one front support member pivotally connected to said second seat portion;

a least one substantially shaped L-bracket pivotally connected to said at least one front support member and pivotally connected to said first seat portion, said actuator being operatively connected to said at least one substantially shaped L-bracket;

a series of substantially vertical support members operable for supporting one of said first seat portion or said second seat portion when said first seat portion is disposed in the same plane as said second seat portion, and operable for supporting said at least one substantially shaped L-bracket when said first seat portion is disposed in the same plane as said second seat portion; and wherein when said actuator is actuated, said actuator moves said substantially shaped L-bracket, which in turn moves said second seat portion, causing said first seat portion to pivot relative to said second seat portion, moving said first seat portion and said second seat portion from said first position, and when said first seat portion and said second seat portion are not in said first position, said first seat portion will be in a different plane than said second seat portion and one of said first seat portion or said second seat portion will lift off one of said series of substantially vertical support members, and said at least one substantially shaped L-bracket will lift off another of said series of substantially vertical support members, and said second seat portion is positioned for removing direct support of a user's legs from said second seat portion, and said first seat portion is positioned at an angle and moves forward, thereby allowing the user to position their legs underneath their body.

10. The stand up chair of claim 9, wherein said actuator can move said first seat portion and said second seat portion from said first position to a second position in which said first seat portion is substantially perpendicular to said second seat portion.

11. The stand up chair of claim 9, further comprising:

said at least one front support member including a first front support member connected to said second seat portion with a third hinge, and a second front support member connected to said second seat portion with a fourth hinge;

a first V-bracket connected to said first front support member;

a second V-bracket connected to said second front support member;

a lower frame member connected to said first V-bracket and said second V-bracket, said lower frame member supporting said actuator; and wherein when said actuator is activated, said first seat portion will pivot about said first hinge and said second hinge relative to said second seat portion, and said second seat portion will pivot about said third hinge relative to said first support member and said fourth hinge relative to said second support member, and said second seat portion will align with said first front support member and said second front support member, moving said first seat portion and said second seat portion from said first position to said second position.

12. The chair of claim 11, further comprising:

said at least one substantially shaped L-bracket including a first substantially shaped L-bracket connected to said first seat portion by a fifth hinge, and connected to said first front support member with a sixth hinge;

said at least one substantially shaped L-bracket including a second substantially shaped L-bracket connected to said first seat portion with a seventh hinge, and connected to said second front support member with an eighth hinge;

said series of substantially vertical support members further comprising a series of substantially vertical elongated support members for supporting said first seat portion;

said series of substantially vertical support members further comprising a series of substantially vertical shortened support members for supporting said first substantially shaped L-bracket and said second substantially shaped L-bracket; and wherein when said actuator is activated, said first substantially shaped L-bracket will pivot about said fifth hinge and said sixth hinge, said second substantially shaped L-bracket will pivot about said seventh hinge and said eighth hinge, allowing said second seat portion to align with said first front support member and said second front support member.

13. The chair of claim 9, wherein said actuator is a lift motor screw mechanism comprising:

an electric motor having a screw member;

a threaded sleeve operably associated with said screw member, said threaded sleeve operable to be pivoted in relation to said first seat portion; and wherein when said electric motor is actuated, said screw member will rotate causing said threaded sleeve to translate along said screw member, applying force to said first seat portion.

14. The chair of claim 13, wherein said threaded sleeve is pivotably connected to said at least one substantially shaped L-bracket.

15. The standup chair of claim 9, further comprising a leg rest comprising:

at least one track member;

a leg rest frame having at least one roller disposed within said track member;

a footrest connected to said frame;

a handle connected to said frame with a hinge;

a receiving bracket operably associated with said handle; and wherein when force is applied to said handle, said at least one roller will roll in said track member, allowing said leg rest frame and said footrest to move from a retracted position to an extended position, and when said leg rest frame and said footrest are in said second position, said handle is inserted into said receiving bracket to maintain said leg rest frame and said footrest in said second position.

16. A standup chair, comprising:

a first seat portion pivotably connected to a second seat portion;

a first front support member and a second front support member pivotably connected to said second seat portion;

an actuator for moving said first seat portion relative to said second seat portion, said first front support member, and said second front support member;

a least one substantially shaped L-bracket pivotally connected to said first seat portion and pivotally connected to one of said first front support member or said second front support member, said actuator being operatively connected to said at least one substantially shaped L-bracket;

at least two substantially vertical support members, one of said at least two substantially vertical support members operable for supporting one of said first seat portion or said second seat portion when said first seat portion is disposed in the same plane as said second seat portion, and another of said at least two substantially vertical support members operable for supporting said at least one substantially shaped L-bracket when said first seat portion is disposed in the same plane as said second seat portion; and wherein said first seat portion and said second seat portion are in a first position when said first seat portion and said second seat portion are disposed in the same plane, when said actuator is actuated, said actuator moves said at least one substantially shaped L-bracket, which in turn moves said second seat portion, causing said first seat portion to be disposed in a different plane from said second seat portion, one of said first seat portion or said second seat portion will lift off one of said at least two substantially vertical support members, and said at least one substantially shaped L-bracket will lift off another of said at least two substantially vertical support members, and when actuator moves said first seat portion and said second seat portion into a second position, said first seat portion will be substantially perpendicular to said second seat portion and said second seat portion will be substantially parallel to said first front support member and said second front support member, said first front support member and said second front support member being substantially perpendicular to a ground surface such that said second seat portion is positioned for removing direct support of a user's legs from said second seat portion, and said first seat portion is positioned at an angle and moves forward, thereby allowing the user to position their legs underneath their body.

17. The standup chair of claim 16, further comprising:

a first V-bracket connected to said first front support member, and a second V-bracket connected to said second front support member;

a front frame member connected to said first front support member and said second front support member;

a lower frame member for supporting, and pivotably connected to said actuator comprising a lift motor screw mechanism having a screw member and a threaded sleeve, said threaded sleeve pivotably connected to said at least one substantially shaped L-bracket;

a leg rest operably associated with said first V-bracket and said second V-bracket; and wherein when said lift screw mechanism is activated, said screw member will rotate and cause said threaded sleeve to translate along said screw member and said first seat portion to pivot relative to said second seat portion, and said second seat portion to rotate relative to and become aligned with said first front support member and said second front support member.

18. The chair of claim 17, further comprising:

said at least one substantially shaped L-bracket including a first substantially shaped L-bracket pivotably connected to said first seat portion and said first front support member;

said at least one substantially shaped L-bracket including a second substantially shaped L-bracket pivotably connected to said first seat portion and said second front support member;

said at least two substantially vertical support members including at least one substantially vertical elongated support member for supporting said first seat portion;

said at least two substantially vertical support members including at least one substantially vertical shortened support member for supporting said first substantially shaped L-bracket or said second substantially shaped L-bracket; and wherein when said lift screw mechanism is activated, and said screw member causes said threaded sleeve to translate, said first seat portion will lift off of said at least one elongated support member, and said first substantially shaped L-bracket and said second substantially shaped L-bracket will lift off of said at least one shortened support member.

19. The chair of claim 16, wherein said leg rest further comprises:

at least one track member;

a leg rest frame having at least one roller disposed within said track member;

a footrest connected to said frame;

a handle connected to said frame with a hinge;

a receiving bracket operably associated with said handle; and wherein when force is applied to said handle, said at least one roller will roll in said track member, allowing said leg rest frame and said footrest to move from a first position to a second position, and when said leg rest frame and said footrest are in said second position, said handle is inserted into said receiving bracket to maintain said leg rest frame and said footrest in said second position.

* * * * *